US007302880B1

(12) United States Patent
Elasic

(10) Patent No.: US 7,302,880 B1
(45) Date of Patent: Dec. 4, 2007

(54) BALLISTIC SHIELD WITH INTEGRAL FIREARM

(76) Inventor: John Elasic, 10 Nick Ct., Bear, DE (US) 19701

( * ) Notice: Subject to any disclaimer, the term of this patent is extended or adjusted under 35 U.S.C. 154(b) by 0 days.

(21) Appl. No.: 10/709,626

(22) Filed: May 18, 2004

(51) Int. Cl.
*F41H 7/00* (2006.01)

(52) U.S. Cl. ..... 89/36.07; 89/36.06; 89/36.05; 89/36.01

(58) Field of Classification Search ..... 89/36.07, 89/36.06, 36.05, 36.01; 2/2.5; 109/49.5
See application file for complete search history.

(56) References Cited

U.S. PATENT DOCUMENTS

| | | | | | |
|---|---|---|---|---|---|
| 33,854 | A | * | 12/1861 | Seely | 89/1.41 |
| 377,732 | A | * | 2/1888 | Adams | 2/2.5 |
| 1,227,544 | A | * | 5/1917 | Lobdell | 356/255 |
| 1,244,679 | A | * | 10/1917 | Winn | 89/36.06 |
| 1,279,571 | A | * | 9/1918 | Moloney | 2/2.5 |
| 1,281,400 | A | * | 10/1918 | Larnell | 89/36.09 |
| 1,282,752 | A | * | 10/1918 | Carrino | 109/49.5 |
| 1,301,293 | A | * | 4/1919 | Molvig | 89/36.06 |
| 1,308,286 | A | * | 7/1919 | Korn | 89/36.09 |
| 1,466,669 | A | * | 9/1923 | Martinson | 2/2.5 |
| 1,747,142 | A | * | 2/1930 | Campbell | 89/40.03 |
| 2,020,702 | A | * | 11/1935 | Russell | 2/2.5 |
| 2,316,055 | A | * | 4/1943 | Davey | 89/36.05 |
| 2,457,929 | A | * | 1/1949 | Slockbower | 42/70.01 |
| 3,766,865 | A | * | 10/1973 | Cutler | 109/49.5 |
| 4,016,666 | A | * | 4/1977 | Finn et al. | 42/1.09 |
| 4,153,927 | A | * | 5/1979 | Owens | 362/99 |
| 4,245,546 | A | * | 1/1981 | Chaires | 89/36.09 |
| 4,412,495 | A | | 11/1983 | Sankar | |
| 4,442,780 | A | | 4/1984 | Child | |
| 4,982,645 | A | | 1/1991 | Abboud | |
| 5,060,554 | A | * | 10/1991 | Aharon | 89/41.19 |
| 5,392,686 | A | | 2/1995 | Sankar | |
| 5,473,501 | A | | 12/1995 | Claypool | |
| 5,829,653 | A | * | 11/1998 | Kaiser | 224/577 |
| 6,098,196 | A | * | 8/2000 | Logan | 2/2.5 |
| 6,272,781 | B1 | | 8/2001 | Resnick | |
| 6,283,609 | B1 | | 9/2001 | Parsons et al. | |
| 6,367,943 | B1 | * | 4/2002 | Tocci et al. | 362/103 |
| 6,435,071 | B1 | * | 8/2002 | Campbell | 89/36.08 |
| 6,564,687 | B2 | * | 5/2003 | Poole | 89/1.11 |
| 6,807,890 | B1 | * | 10/2004 | Fuqua | 89/36.02 |
| 6,845,701 | B2 | * | 1/2005 | Drackett | 89/36.09 |
| 6,886,446 | B1 | * | 5/2005 | Baker | 89/36.05 |
| 7,051,637 | B2 | * | 5/2006 | Clark et al. | 89/36.06 |
| 2003/0110933 | A1 | | 6/2003 | Baker | |

FOREIGN PATENT DOCUMENTS

| | | | |
|---|---|---|---|
| DE | 3146903 | A1 | 6/1983 |
| DE | 8134517 | U1 | 4/1985 |
| FR | 454748 | A | 2/1915 |
| GB | 04376 | A | 0/1915 |
| JP | 2000039297 | A | 5/2000 |

* cited by examiner

*Primary Examiner*—Michelle Clement
(74) *Attorney, Agent, or Firm*—Connolly Bove Lodge & Hutz LLP

(57) ABSTRACT

A ballistic shield has a handle to allow for one arm deployment. The shield also includes an integral window and a firearm mounted to the shield that may be dischargeably operated in its mounted position. Optionally, a second firearm at a different orientation from the first firearm, and/or other weapons or accessories may be mounted to the shield.

20 Claims, 4 Drawing Sheets

BALLISTIC SHIELD WITH INTEGRAL FIREARM

FIELD OF THE INVENTION

The present invention pertains to a hand-carried, ballistic shield for law enforcement, military or aviation use that has one or more integral firearms and optionally other weapons detachably engaged therewith.

BACKGROUND OF THE INVENTION

Law enforcement, military and aviation personnel, among others, have need for protective gear when responding to riots, terrorism, military engagement or other violent situation or conflict. Bullet-proof vests, goggles, helmets and other apparel are available. However, there is also a need for portable, hand-carried ballistic shields that may be deployed and used to protect personnel on short notice.

U.S. Pat. No. 4,412,495 shows a body protective shield that is formed from bullet-proof fabric panels and in-cludes a bullet-proof window. This shield provides passive protection only, and does not incorporate any weapons, lighting or communication equipment to assist enforcement personnel with responding to a conflict.

U.S. Pat. No. 5,392,686 similarly discloses a protective shield formed from a bullet-proof fabric and has a viewing window therethrough. The shield provides passive protection only, and does not incorporate any weapons, lighting or communication equipment to assist enforcement personnel with responding to a conflict.

U.S. Pat. No. 4,442,780 illustrates a clipboard formed of bullet-proof material that has a gas or aerosol dispenser within a handgrip on the side of the clipboard. The clipboard cannot protectively cover a substantial portion of an enforcement officer's head and torso. Nor does the clipboard include a viewing window to enable the officer to deploy the aerosol weapon with precision while having his head and face protected from an assailant.

SUMMARY OF THE INVENTION

In a first aspect, the invention is a ballistic shield formed of a ballistic material that has a viewing window therethrough. A handle is mounted to the reverse face of the shield so that the shield may be held by a law enforcement officer or other personnel. A preferred handle is a forearm cuff. One or more firearms are mounted to the shield and remain dischargeably operable when so mounted. In one embodiment, a firearm is mounted so that it will discharge in a direction substantially perpendicular to the front face of the shield. In another embodiment, a firearm is mounted so that it will discharge in a direction substantially parallel to the rear face of the shield. In a particularly preferred embodiment, two firearms are mounted to the shield, such that one firearm will discharge in a direction substantially perpendicular to the front face of the shield and the other will discharge in a direction substantially parallel to the rear face of the shield. It is particularly preferred to have the shield be employable and the firearm be dischargeable with a single arm operation.

Preferably, the one or more firearm are selected from the group consisting of: taser guns, pistols, revolvers and gas discharge firearms. A battery may also be mounted to the shield that can re-charge the firearm(s) that require charging, such as taser guns.

In one embodiment, a disabling sensor is incorporated. The disabling sensor will disable the one or more firearms in response to a predetermined signal or a predetermined absence of a signal. One form of disabling sensor is an emergency cut off switch with a cord or lanyard, which is sometimes called a kill switch.

Preferably, the ballistic material forming the shield is selected from the group consisting of: boron carbide, silicon carbide, silicon nitride, aluminum oxide, alumina ceramic, titanium diboride, reinforced fiberglass composite, and mixtures of such materials.

Preferably, the viewing window through the shield is formed from a material selected from the group consistng of: bullet proof glass and polycarbonate polymer. One or more mirrors optionally are associated with the viewing window to extend the field of vision through said viewing window.

Preferably, the ballistic shield further comprises one or more communications accessories mounted to the shield, such as a radio, a camera, a digital camera, a video camera, a cellular phone, a cellular video, an audio speaker, a megaphone, a homing signaling device, and a global positioning transponder.

Preferably, the ballistic shield further comprises one or more light sources mounted to the shield. The light sources may be flash bars or strobe lamps, or LED lamps or halogen lamps.

Novel features and advantages of the present invention in addition to those noted above will become apparent to those of ordinary skill in the art from a reading of the following detailed description in conjunction with the accompanying drawings.

DETAILED DESCRIPTION OF THE INVENTION

Figure 1:
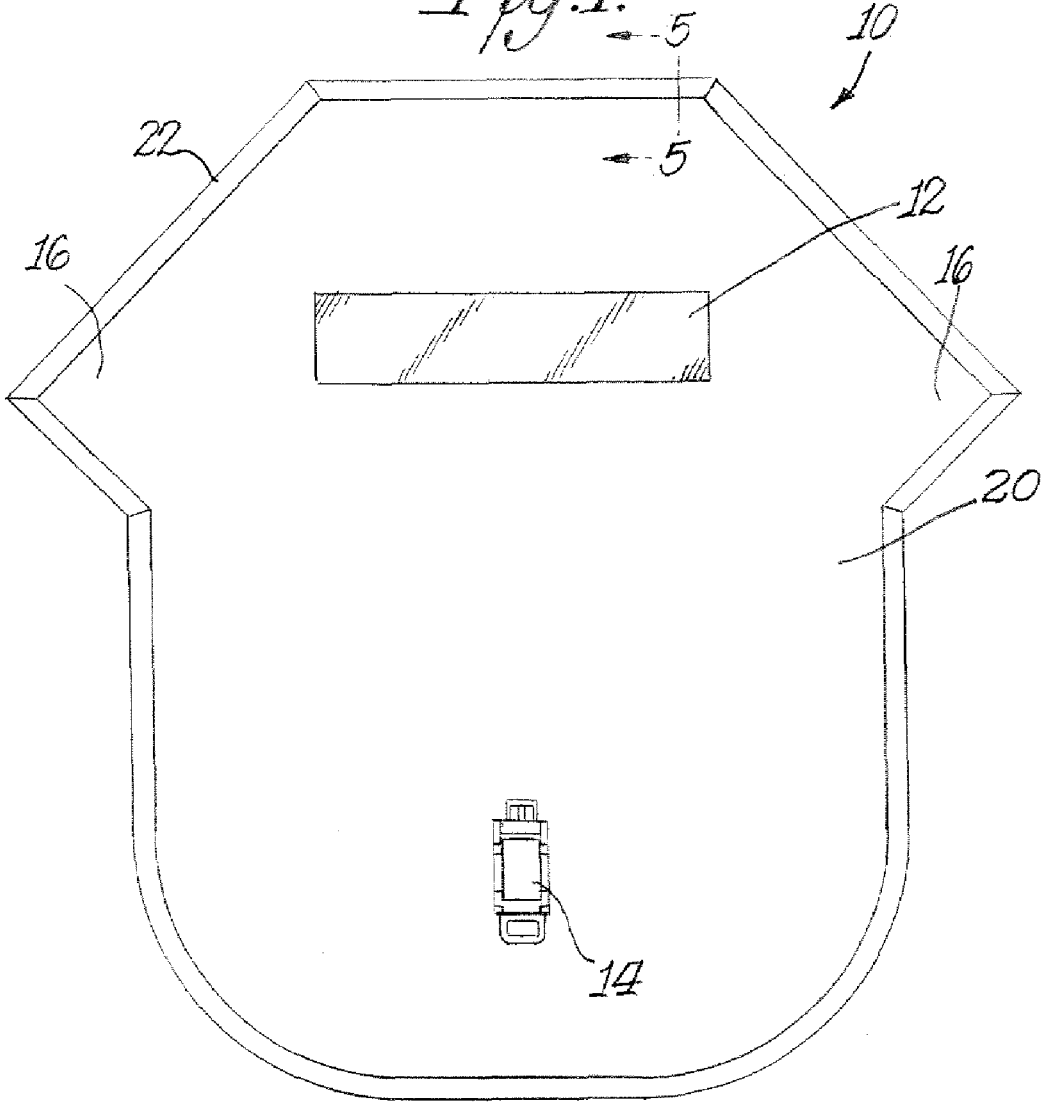
FIG. 1 is a front elevational view of a portable ballistic shield of the invention.

Referring particularly to the drawings, wherein like numerals denote identical parts in the various views, FIG. 1 shows a front view of the ballistic shield 10 according to a first embodiment of the invention. The ballistic shield 10 incorporates therein a viewing window 12 and one or more stun gun firearms 14 . The shield 10 as shown in FIG. 1 has an upper portion and a lower portion with wings 16 extending outwardly from the upper portion.

Preferably, the ballistic shield 10 is formed from one or more materials known to be useful for constructing body armor and ballistic shields. The material preferably is bullet-proof and knife blade slash-proof to maximize the protection offered to the enforcement personnel using the shield. One such material is a woven fabric formed from KEVLAR plastic fibers, which may be incorporated into a laminate or encased in a resin. KEVLAR products are available from E.I. DuPont de Nemours and Company. Another material is a ceramic armor made of boron carbide, silicon carbide, silicon nitride, aluminum oxide or alumina ceramic, or titanium diboride, available from Ceradyne, Inc., Life-Guard Ballistic Armor, Lumagard Prolite Armor Systems, and Morgan Advanced Ceramics. A further alternate material is a composite of synthetic fibers encased in a resin matrix, such as SPECTRA SHIELD polyethylene fiber composites and GOLD SHIELD aramid fiber composites available from Allied Signal. TWARON aramid fibers from Akzo Nobel also may be used. The resulting shield formed with such material should perform satisfactorily, such as to meet the Level IIIA NIJ 010801 STD law enforcement safety rating for ballistic protection.

Figure 5:
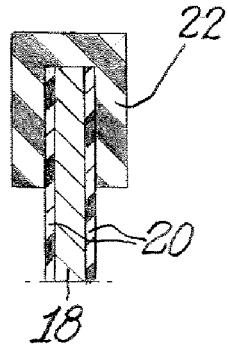
FIG. 5 is fragmental cross-sectional view taken along line 5-5 of FIG. 1.

Referring to FIG. 5, the upper edge of the ballistic shield 10 is shown in cross-section. The embodiment of FIGS. 1-6 has a metal core 18 surrounded by a ballistic material 20 , such as a KEVLAR fabric. The edge of the shield is covered by a polymeric U-shaped edging 22 , which holds the multiple components forming the shield together and also helps absorb scratches and bumps to the edges of the shield 10 when in use and when being stored. Possible edge guard materials include urethanes, polycarbonates, or composite materials such as fiberglass. Alternatively, a ballistic shielding material, such as SPECTRA SHIELD composite, may be compression molded to form the shield base without a metal core or edging.

The window 12 is constructed from a transparent or translucent ballistic material that enables the enforcement personnel using the shield to maintain his head behind the shield, yet still have ability to view an assailant or a crowd to be controlled through such window. Preferably, the window is bullet-proof and slash-proof. One possible material for forming the window 12 is LEXAN polycarbonate polymer available from GE Plastics. Alternatively, the window is formed from bullet-proof glass available from First Defense International Group or Paulson Manufacturing Corp.

Figure 2:
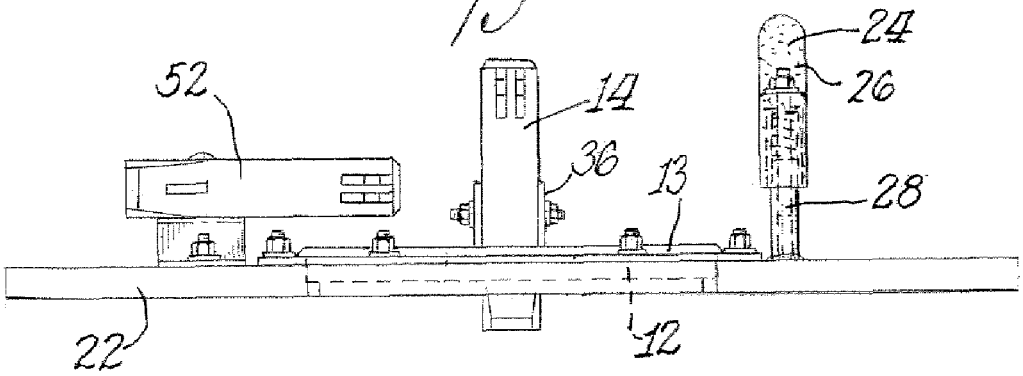
FIG. 2 is a top plan view of the ballistic shield of FIG. 1.
Figure 3:
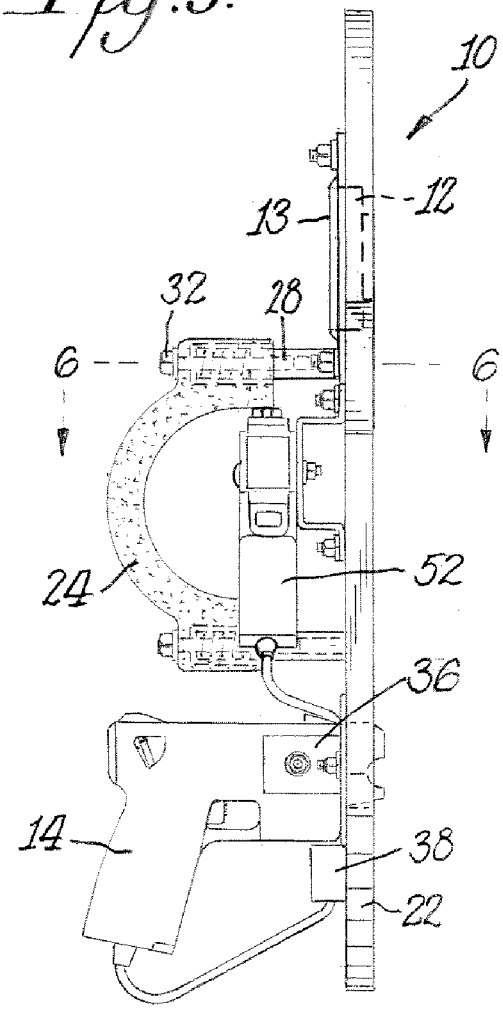
FIG. 3 is a left side elevational view of the ballistic shield of FIG. 1.
Figure 4:
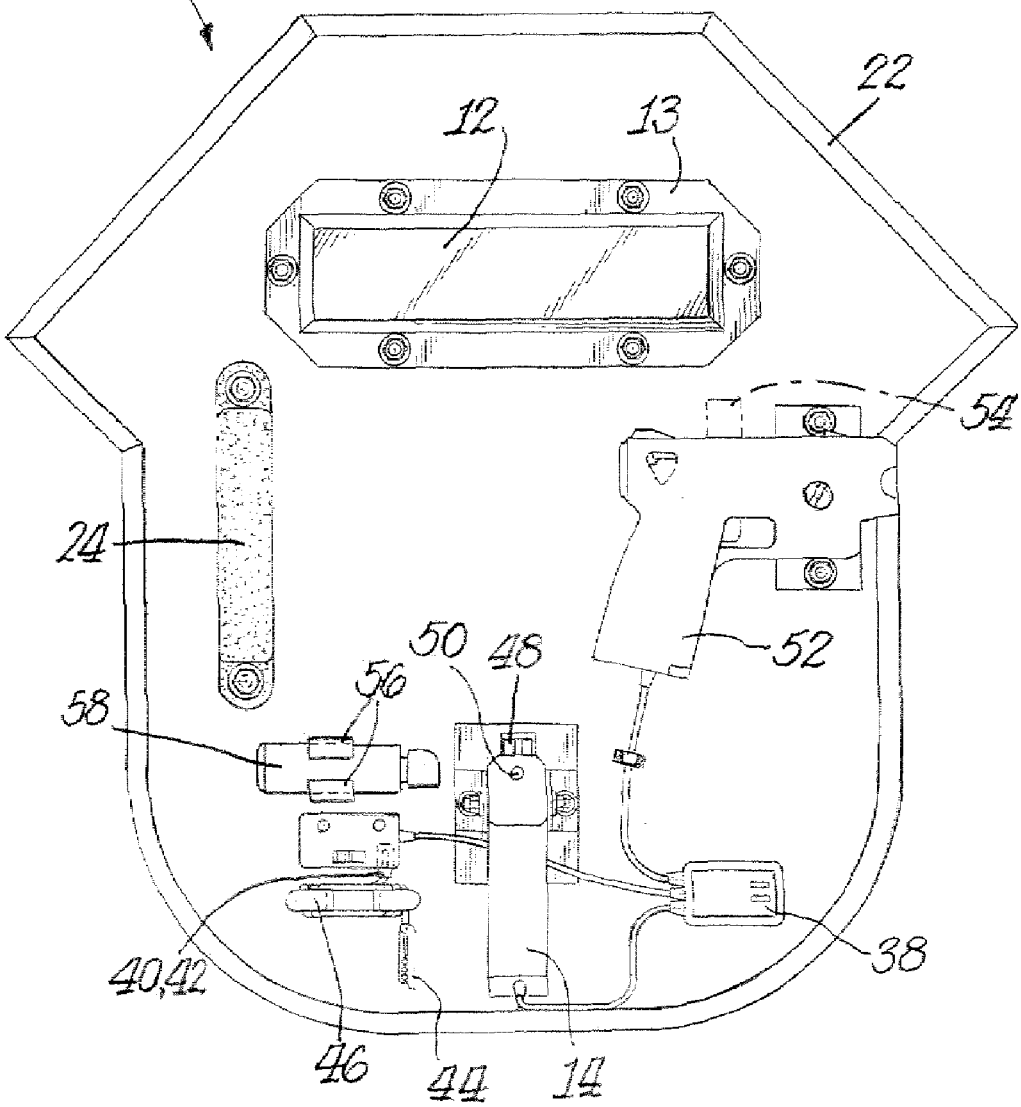
FIG. 4 is a rear elevational view of the ballistic shield of FIG. 1.

As shown in FIGS. 2 through 4, the window 12 has a frame 13 that holds the window 12 within an opening defined in the shield 10. The frame in this embodiment is engaged with the ballistic shield by bolt attachment, but other fastening means, such as adhesive or stitching, may be used.

The ballistic shield 10 is provided with a handle or forearm cuff 24. Referring particularly to FIGS. 2 and 3, the forearm cuff 24 is attached to the rear face of the ballistic shield 10, in a position offset from the centerline of the shield 10. This placement enables the enforcement officer to hold the shield 10 in a protective position (in front of at least a portion of his body) with his arm through the forearm cuff 24 while concurrently engaging a weapon integral with the shield with his hand as further explained below. His other arm and other hand may remain free to hold other weapons or communications equipment or accessories as will be explained in more detail below.

Figure 6:
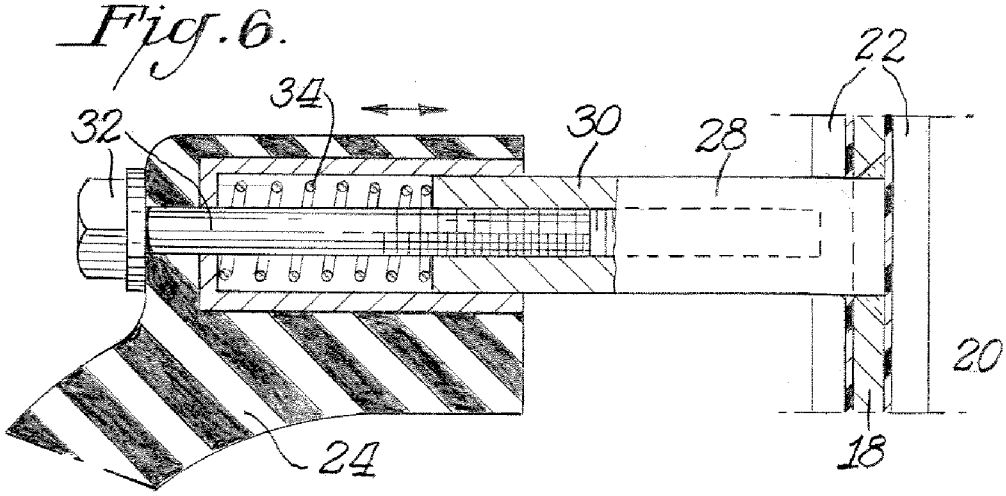
FIG. 6 is a fragmental side elevational view in cross-section taken along line 6-6 of FIG. 3.

The forearm cuff 24 shown in FIGS. 2, 3 and 6 is covered with a padding material 26 , such as a resilient latex or urethane foam. The curved portion of the forearm cuff 24 is mounted for adjustable movement to posts 28. Referring particularly to FIG. 6, posts 28 have one end welded or otherwise fastened to the shield 10. The padded curved portion of the forearm cuff 24 defines an opening at each end through which the opposite ends of posts 28 are inserted. Preferably, a sleeve 30 protects a respective opening in the cuff 24. The posts 28 define internal threads that mate with external threads on a bolt 32. As bolt 32 is turned, the mating threads engage and the cuff 24 is moved toward the ballistic shield 10. As bolt 32 is turned the opposite rotational direction, the cuff 24 moves farther away from the shield 10. A biasing spring 34 urges the cuff 24 away from the end of the post 28.

In the embodiment shown in FIGS. 1 through 6, the shield 10 is provided with multiple integral weapons. First, a firearm 14 , such as a taser stun gun, is held so as to be pointed in a direction substantially perpendicular to the front face of the shield 10. In this configuration, the enforcement officer may hold the firearm handle with the hand on the arm that is not engaged in the forearm cuff 24 . The firearm 14 (taser gun in FIGS. 1-6) is engaged to the ballistic shield 10 with its barrel inserted through an opening formed in the shield 10 . A frame 36 around the opening is attached to the rear face of the ballistic shield 10 and holds the firearm 14 in position. The firearm 14 may be discharged to impact a target person/assailant located in front of the enforcement officer using the shield 10 without separating the firearm 14 from the shield 10.

The firearm 14 may be any one of available electronic weapons called taser guns or stun guns available to law enforcement personnel. When discharged, a taser gun generally emits an eletro-muscular disruption charge wave to immobilize or impair temporarily a target person within range of the gun. Exemplary taser guns are available from Taser International of Scottsdale, Arizona.

The firearm 14 (taser gun in FIGS. 1-6) is wired to a battery recharger 38 that is mounted on the rear face of the ballistic shield 10 . The firearm 14 is further wired to a disabling sensor 40 or cutoff switch/deadman switch that will disable the firearm 14 from operating if the sensor is not operatively attached to the firearm 14 . For example, as shown in FIG. 4, one end of a lanyard or cord 42 is attached to the sensor 40 and the other end of the cord 42 is attached to a clamp 44, such as an alligator clamp, that may be attached to the enforcement officer's clothing or belt. Preferably, a clip 46 is provided for wrapping the cord 42 when not in use. One type of general emergency cut off switch with a lanyard cord is available from Polaris Industries, Inc. of Medina, Minnesota.

If the cord 42 is separated from the disabling sensor 40, the sensor will kill the battery power to the firearm 14 (taser gun in FIGS. 1-6) and disable the firearm 14 from discharging. This feature protects the enforcement officer. Thus, if the shield 10 was pulled away from the officer such that the cord 42 is separated from the sensor 40, the firearm 14 could not be discharged to immobilize the officer.

In the embodiment shown in FIG. 4, the firearm 14 (taser gun in FIGS. 1-6) is also provided with an infrared sighting 48 and a low battery indicator light 50. The battery charger 38 is removably attachable to the reverse side of the shield 10 to enable the enforcement officer to recharge the taser gun battery when the shield 10 is not in use.

Optionally, and preferably, a second firearm 52 (taser gun in FIGS. 1-6) is mounted to the reverse side of the ballistic shield 10 in a direction parallel to the reverse side surface of the shield 10. In the mounting configuration shown in FIG. 4, the second firearm 52 is mounted so that it can be held by the enforcement officer's hand on the arm that is held in the forearm cuff 24 and is holding up the shield 10. The enforcement officer thus has ability to discharge the firearm 52 toward an assailant approaching from the side of the shield 10 without dis-engaging the second firearm 52 from the shield 10. Preferably, the second firearm 52 (a taser gun in FIGS. 1-6) is attached for re-charging through battery recharger 38, and is attached to the disabling sensor 40 so that it may be disabled from firing if the shield 10 is separated from the enforcement officer. As shown in FIG. 4, the second firearm 52 (taser gun in FIG. 4) is provided with an optional infrared sight 54 to help aim the weapon.

Optionally, and preferably, additional defensive weapons may be mounted onto the ballistic shield 10 for ready access by the enforcement officer. As shown in FIG. 4, a spring clamp 56 is mounted to the reverse side of the ballistic shield 10. An aerosol spray container 58 of a liquid chemical, such as pepper spray or MACE, is held within the clamp 56. Alternatively, one of the taser guns may be re-configured to store and deploy a liquid chemical agent.

If desired, alternative firearms may be mounted to the ballistic shield 10 in addition to or in place of the taser guns. While not shown, alternative firearms such as revolvers, pistols, electric firearms, spring firearms and gas firearms may be mounted to the shield.

If desired, other weapons and/or other accessories may be mounted to the ballistic shield 10 in addition to the taser gun(s).

Figure 7:
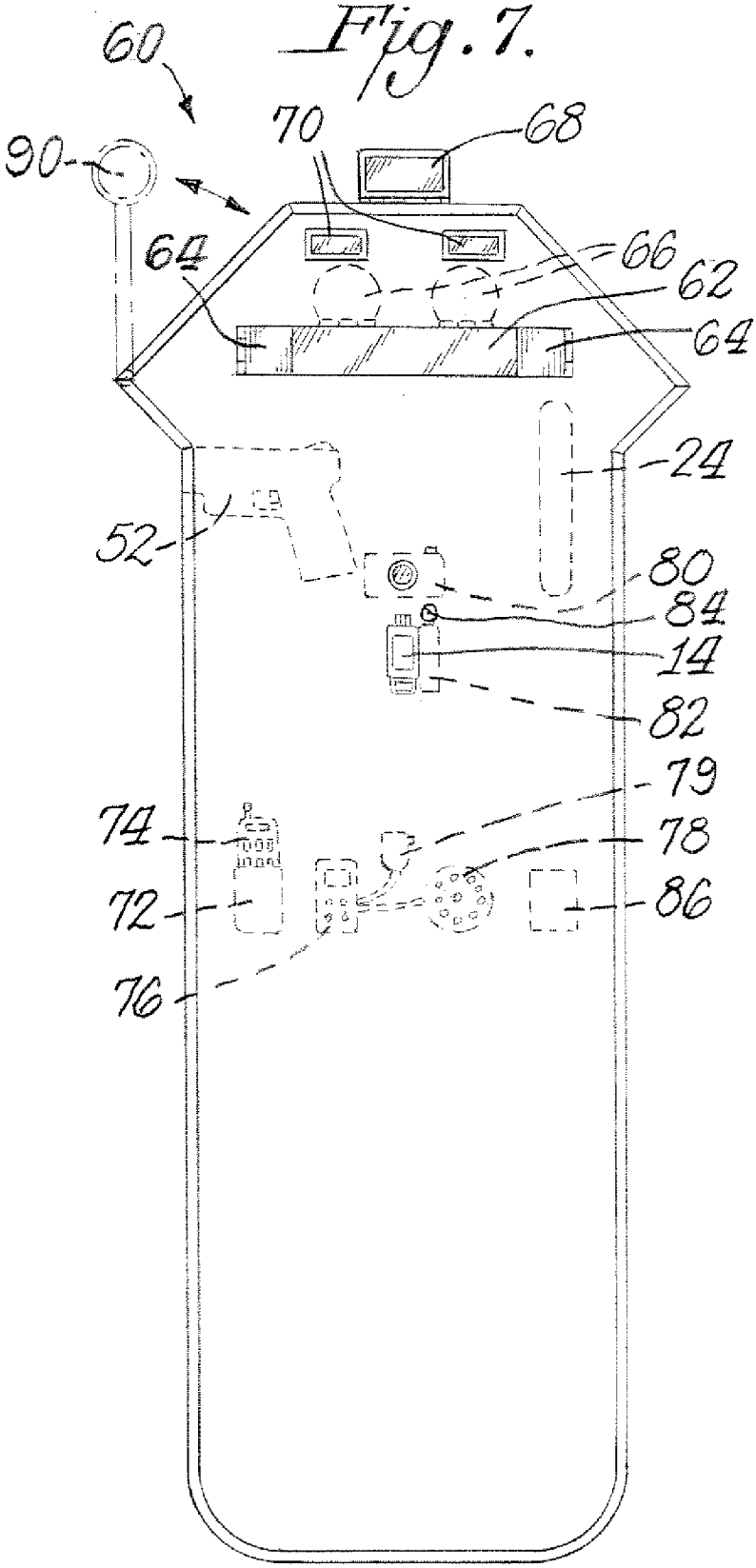
FIG. 7 is a front elevational view of an alternative portable ballistic shield of the invention that has a longer length and additional accessories.

Referring next to FIG. 7, an alternate embodiment of the ballistic shield 60 has a longer length to more completely protect an enforcement officer's lower body and legs. In this alternate embodiment 60 the firearm 14 has an associated aerosol spray container 82 that may be activated to deploy a gas or liquid chemical stream through a hole 84 in the shield 60 concurrently as the firearm 14 is activated. Such aerosol spray container may also be activated independently, but by the same hand that engages the firearm 14. Thus, in this embodiment, the enforcement officer has access to two types of disabling or disarming weapons mounted integrally onto the shield that may be operated singly or jointly/concurrently with a single hand, and without separating the weapons from the shield 10.

This alternate embodiment of the ballistic shield 60 still includes a viewing window 62, but the window further has associated therewith hinged mirrors 64 that open like window-shutters to allow the enforcement officer behind the shield to enhance peripheral vision to each side without otherwise moving out of position from behind the shield. In addition, night vision lenses 66 are hinge-mounted to the window 62 so that they can be positioned over the window 62 to improve vision when the shield 60 is used at night. One brand of suitable night vision lenses is available from ITT Industries Night Vision.

Other features to improve the effectiveness of the shield 60 when used at night include a fold-out halogen or LED lamp 68, and high intensity flash bars 70. The fold-out lamp 68 serves as a lighting source. The high intensity flash bars 70 provide a blinding beam that may be used in combination with any one or multiple of the other features to subdue an assailant. As an alternative to the fold-out lamp 68 that may be used separately or in combination with lamp 68, a lamp 90 optionally may be installed on a pivotable swing arm that may be rotated into an upstanding position to project a light beam outwardly from the shield 60. For lamps 68 or 90, suitable halogen lamps may be obtained from General Electric. Sylvania offers suitable LED lamps. Strobes are available from Ecco Manufacturing and from Strobes and More.

Additional accessories may be mountably attached to the reverse side of the ballistic shield 60. For example, a holder 72 may be provided for a cell phone 74 or other satellite or radio communications system. Alternatively, a radio transmitter 76 and speaker 78 with microphone 79 may be mounted to the shield 60. The shield may include an integral video or digital camera 80 that may transmit or simply store images of the conflict encountered by the enforcement officer. Moreover, the shield 60 may be provided with a global positioning transponder or a homing device 86 so that shield 60 may be tracked and recovered if it is taken from an enforcement officer. Suitable GPS systems are available from Garman, Magellan, Delorme, Northstar, Loweance and Navman.

Some or all of the accessories shown mounted to shield 60 of course may be mounted to shield 10, and vice versa.

Many other desirable and advantageous features of this invention will become apparent from the foregoing disclosure. Moreover, while this disclosure explains important aspects of this invention in considerable detail for purposes of illustration, it will be understood by those skilled in the art that many of these details may be varied without departing from the spirit and scope of the invention.

The invention claimed is:

1. A hand-held ballistic shield, comprising:

a shield having a front face and a reverse face and formed of a ballistic material;

a viewing window through the shield;

a handle associated with the shield for carrying the shield or holding the shield in front of at least a portion of a user's body wherein the reverse face is directed toward the user's body when the shield is deployed in front of at least a portion of the user's body and the front face is directed away from the user's body;

a firearm permanently mounted to the shield and dischargeably operable when so mounted and when said shield is deployed in front of at least a portion of said user's body which portion includes said user's hand contacting an actuator or trigger of said firearm, wherein said firearm is mounted for discharge in a direction at an angle outwardly from the front face of the shield and the firearm actuator or trigger is on or adjacent to the reverse face of the shield.

2. The ballistic shield of claim 1, wherein the firearm is selected from the group consisting of: taser guns, pistols, revolvers, gas discharge firearms.

3. The ballistic shield of claim 1, wherein the ballistic material is selected from the group consisting of: boron carbide, silicon carbide, silicon nitride, aluminum oxide, alumina ceramic, titanium diboride, reinforced fiberglass composite, reinforced fiber and polymer resin composite, and mixtures of such materials.

4. The ballistic shield of claim 1, wherein the viewing window is formed from a material selected from the group consisting of bullet proof glass and polycarbonate polymer.

5. The ballistic shield of claim 1, wherein the handle is a forearm cuff.

6. The ballistic shield of claim 1, wherein the firearm is a taser gun, and further comprising a battery mounted to the shield for charging the taser gun.

7. The ballistic shield of claim 1, further comprising a disabling sensor to disable the firearm in response to a predetermined signal or a predetermined absence of a signal.

8. The ballistic shield of claim 1, wherein the firearm is mounted so that it discharges in a direction substantially perpendicular to the front face of the shield.

9. The ballistic shield of claim 1, further comprising a second firearm mounted to the shield.

10. The ballistic shield of claim 9, wherein the second firearm is mounted so that it discharges in a direction substantially parallel to the rear face of the shield.

11. The ballistic shield of claim 1, further comprising a second weapon mounted to the rear face of the shield.

12. The ballistic shield of claim 1, further comprising one or more communications accessories mounted to the shield.

13. The ballistic shield of claim 12, wherein the communications accessories are selected from the group consisting of: radio, camera, digital camera, video camera, cellular phone, cellular video, audio speaker, megaphone, homing signaling device, and global positioning transponder.

14. The ballistic shield of claim 1, further comprising one or more mirrors associated with the viewing window to extend the field of vision through said viewing window.

15. The ballistic shield of claim 1, further comprising one or more light sources mounted to the shield.

16. The ballistic shield of claim 1, wherein the shield is employable and the firearm is dischargeable with a single arm operation.

17. A portable ballistic shield, comprising:

a shield having a front face and a reverse face and formed of a ballistic material wherein when said shield is deployed in front of at least a portion of a user's body the reverse face is directed toward the user's body and the front face is directed away from the user's body;

a viewing window through the shield;

a firearm permanently mounted to the shield and dischargeably operable when so mounted and when said shield is deployed in front of at least a portion of a user's body, which portion includes said user's hand contacting an actuator or trigger of said firearm, and wherein said firearm is mounted for discharge in a direction at an angle outwardly from the front face of the shield with the actuator or trigger located on or adjacent to the reverse face of the shield;

a second firearm permanently mounted to the shield and dischargeably operable when so mounted, wherein said second firearm is mounted so as to discharge in a direction that is different from a discharge direction of said first firearm; and at least one disabling sensor to disable the fireas in response to a predetermined signal or a predetermined absence of a signal.

18. The hand-held ballistic shield of claim 1, further comprising a frame for mounting the firearm to the reverse face of the shield.

19. The portable ballistic shield of claim 17, further comprising one or more light sources mounted to the shield.

20. The portable ballistic shield of claim 17, further comprising a handle associated with the shield for carrying the shield or holding the shield in front of a user's body.

* * * * *

UNITED STATES PATENT AND TRADEMARK OFFICE

CERTIFICATE OF CORRECTION

PATENT NO. : 7,302,880 B1
APPLICATION NO. : 10/709626
DATED : December 4, 2007
INVENTOR(S) : John Elasic It is certified that error appears in the above-identified patent and that said Letters Patent is hereby corrected as shown below:

On the Title Page:

In the Foreign Patent Documents, "GB 04376 A 0/1915" should read -- GB 04376 A 9/1915 --.

In the Claims:

In Claim 17, in column 8 and line 12, "fireas" should read -- firearms --.

Signed and Sealed this

Eighth Day of April, 2008

JON W. DUDAS
*Director of the United States Patent and Trademark Office*